US006921340B2

(12) United States Patent
Dickie

(10) Patent No.: US 6,921,340 B2
(45) Date of Patent: Jul. 26, 2005

(54) LASER EQUIPPED GOLF SWING PRACTICE DEVICE AND PRACTICE MAT

(76) Inventor: Robert G. Dickie, 15 Valley Trail, Newmarket, Ontario (CA) L3Y 4V8

( * ) Notice: Subject to any disclaimer, the term of this patent is extended or adjusted under 35 U.S.C. 154(b) by 19 days.

(21) Appl. No.: 10/615,183

(22) Filed: Jul. 9, 2003

(65) Prior Publication Data

US 2005/0009616 A1 Jan. 13, 2005

(51) Int. Cl.[7] ..... A63B 69/36
(52) U.S. Cl. ..... 473/220; 473/219
(58) Field of Search ..... 473/119, 220, 221, 473/223, 226, 278

(56) References Cited

U.S. PATENT DOCUMENTS

| | | | | | |
|---|---|---|---|---|---|
| 3,599,982 | A | * | 8/1971 | Elesh | 473/278 |
| 3,784,208 | A | * | 1/1974 | Weygandt | 473/257 |
| 4,451,043 | A | * | 5/1984 | Ogawa et al. | 473/225 |
| 4,858,934 | A | * | 8/1989 | Ladick et al. | 473/220 |
| 4,971,325 | A | * | 11/1990 | Lipps | 473/209 |
| 5,108,105 | A | * | 4/1992 | Shimizu | 473/225 |
| 5,207,429 | A | * | 5/1993 | Walmsley et al. | 473/220 |
| 5,467,991 | A | | 11/1995 | White, IV | |
| 5,470,072 | A | | 11/1995 | Cunningham | |
| 5,590,882 | A | * | 1/1997 | Todd | 473/218 |
| 5,685,782 | A | * | 11/1997 | Lipps et al. | 473/209 |
| 5,759,110 | A | * | 6/1998 | Seibel et al. | 473/220 |
| 5,826,874 | A | * | 10/1998 | Teitell et al. | 473/225 |
| 5,897,441 | A | * | 4/1999 | Apthorp | 473/220 |
| 6,089,989 | A | * | 7/2000 | Sutcliffe | 473/225 |
| 6,149,537 | A | * | 11/2000 | Hooker | 473/409 |
| 6,254,493 | B1 | * | 7/2001 | Wurster | 473/220 |
| 6,488,592 | B1 | * | 12/2002 | Boatner | 473/220 |
| 6,702,690 | B1 | * | 3/2004 | Albright | 473/265 |
| 2004/0023726 | A1 | * | 2/2004 | Rotson et al. | 473/220 |

* cited by examiner

*Primary Examiner*—Stephen Garbe
*Assistant Examiner*—Nini F. Legesse
(74) *Attorney, Agent, or Firm*—Ellopoulos Intellectual Property Law

(57) ABSTRACT

A golf swing practice comprises a body for attachment to a golf club at the upper end of the club with a second end fitted to the club shaft below the grip. There are a pair of first laser light sources which are directed downwardly and outwardly so as to create diverging beams of light which pass by the front and rear faces of the club head in a plane perpendicular thereto. Securement of the body at the upper end of the golf club is by a pin axially inserted into the end of the club, and by a geared clamp positioned below the grip portion of the golf club so as to be symmetrical about the longitudinal axis thereof. A practice mat has two zones for different stroke practice, and a ball can be struck from it. The speed and direction of a golf club may optionally be determined.

8 Claims, 7 Drawing Sheets

LASER EQUIPPED GOLF SWING PRACTICE DEVICE AND PRACTICE MAT

FIELD OF THE INVENTION

This invention relates to a laser equipped golf swing practice device which can be removably attached to a conventional golf club, including woods, irons, and putters. The invention also provides a practice mat which can be used with the golf swing practice device and, in some circumstances, with a conventional golf club not having the laser equipped golf swing practice device attached thereto. The purpose is to enhance and improve the golf swing of the user by providing a visual determination of the direction of the travel of the head of the golf club during a swing thereof as well as an indication of the "squareness" of the face of the golf club with respect to the direction of its travel. The golf swing practice device of the present invention particularly provides information to the user and to an observer during the backswing and the initial stages of the downswing.

BACKGROUND OF THE INVENTION

Golfers are forever attempting to improve their golf swing. Typically, a golf swing is the same or nearly the same regardless of whether the golfer is using a wood or an iron. The training by which a golfer improves his or her swing is such as to teach the muscles hollow to react and how to move in concert one with another, thereby improving the "muscle memory". Accordingly, there are many devices known, and many professionals who are employed, for purposes of teaching and improving the golf swing of golfers everywhere.

Included among the known devices that are used to improve the golf swing are a number of such devices which employ light sources, light reflectors, or light beams, and which are either built into a golf club or may be attached to a golf club. They are usually mounted to the shaft of the club, and are employed so as to provide a visual indication to the golfer as to the impact face all of the golf club head, and whether it is squared to the target line at the actual point of impact of the golf club head with a golf ball.

However, such devices, including the golf swing practice device of the present invention, are very often used without the presence of a golf ball because their purpose is to improve the swing of the golf club so that when it does impact a golf ball, the ball will travel in the intended direction.

Light equipped devices, and laser equipped devices such as the present device, will create a light trace on the ground or on a practice mat and the like, at the feet of and in front of the golfer, when functioning. Strictly speaking, a relational image is projected onto the ground and it will typically take the form of a dot or line when the light beam impinges on the ground. The present invention, along with several prior art devices which are discussed below, projects two beams of light onto the ground during the downswing of the golf club, so that the intersection of the beams of light at the intended point of impact of the golf club with the golf ball reveals a proper swing, with the club head being square to the intended direction of travel of the ball.

Another aspect of the present invention provides for a third laser light which is located at the top end of the golf club when the golf swing practice device is secured to the golf club, whereby a further indication to the golfer or an observer such as an instructor can be given to ensure that the backswing has been proper, and to ensure that the plane of the swing of the golf club remains essentially planar. When the third laser light projects a line onto the ground, then the golfer and/or the instructor/observer can determine that the club rotation during the backswing has been correct. For example, when the lead arm (the arm of the golfer which is closest to the target) of the golfer is substantially parallel to the ground during the backswing or downswing, then if the club is in the correct plane of the swing, the image from the third laser light will impinge on the ground at or near the ball and/or along the intended line of flight of the ball.

Of course, with either of the pair of first laser light sources, or the third laser light source being activated, an indication is given to the golfer and/or the instructor/observer whether or not the club face of the golf club is "open" or "closed", and thus an indication will be given as to whether upon impact of the golf club with a golf ball the ball will travel in the intended direction or veer to the right or left of the intended path.

Typically, laser light for purposes of the present invention is projected from well known laser diodes, which typically have a wavelength all of 635–688 millimeters, with a maximum output of 5 mW. Such laser diodes are typically found in devices including laser pointers and light; and are particularly suited for use in the present invention since the light output is red, and is therefore not generally affected by ambient light.

The golf swing practice device the present invention is typically adapted to be releasably attached to any standard golf club, including woods, irons, and putters. It may also be permanently attached to a golf club so as to provide a practice club, but such would not be suitable for use during an actual golf game. Among other things, the presence of the golf swing practice device would offend the rules and protocol of golf.

The practice mat of the present invention replicates, in some respects, the mats that are employed at driving ranges and the like, but also provides a second zone which can be employed for purposes of determining the tracking of the golf club face, to provide for practice swings prior to actually addressing a golf ball, and also to permit practice of putting strokes.

To that end, the first zone of the practice mat has a higher elevation than the second zone. This permits the golfer to take a few practice swings, and when the golfer is satisfied that he or she has the swing perfected for the next stroke, the golfer then shuffles forward a bit and addresses a ball placed in the second zone.

The practice mat of the present invention also provides means to determine and annunciate or otherwise indicate the speed of the golf club within the impact zone, and optionally the direction of travel of the golf club.

DESCRIPTION OF THE PRIOR ART

One attachment device known from the prior art is disclosed in U.S. Pat. No. 5,467,991 issued to White. This patent discloses a base mounting plate that may be removably attached to a golf club shaft, and which supports a pair of light emitting diodes (LED's) aimed in opposite directions parallel to the shaft of the club. Since the beam of light emitted from lowermost LED is offset relative to the axis of the golf club, the light trace which that beam makes when it impinges on the ground is behind the club head. Because of this offset, the light trace on the ground does not actually represent the impact location of the golf club with a golf ball since the club face is being rotated as a consequence of the action of the hands of the golfer at that moment. Moreover, the second LED on the White device also emits a beam of light which is offset and parallel to the axis of the shaft; however, in this instance the beam of light extends in a direction opposite to the first or lowermost beam. This second or upper beam is intended to produce a light trace on the ground which is parallel to the desired target during the latter part of the backswing or the early part of the downswing, and during the follow-through.

The White golf swing training device may be useful in assisting a golfer in determining if his or her swing follows the correct swing plane by observing the two light traces as they impinge on the ground, but it is not possible through the use of a single and offset downwardly projecting light beam to determine whether the face of the club head at the point of impact—real or imaginary—with the golf ball is on line with the ball, "square" to the ball, or whether it is "open" or "closed" with respect to the ball. The latter circumstances are typically referred to as toe-in and toe-out, resulting in an unwanted sidespin to the ball and thus resulting in a hook or slice of the ball.

Cunningham U.S. Pat. No. 5,470,072 teaches two spaced apart light sources which are positioned at the crown or top surface of a club head and which are also positioned in a plane that is perpendicular to the ball impact face of the club head. If the light tracings from the light sources, which are directed upwards or reflected upwards towards the golfer who swings the club, and not to the ground, appear to be superimposed at the point of actual or imaginary impact with the ball, then there is an indication as to whether the golfer has swung the golf club so that the face of the club is square to the ball. If the two light tracings in the vicinity of the ball impact are offset one with respect to the other, then there is an indication that the club face is not square, and is either in a toe-in or toe-out condition.

Cunningham also teaches a bar which may be attached to a lower portion of the shaft of the club and which will carry light sources or light reflectors thereon. This provides the golfer with the same interpretive information as is given when the light sources are positioned on the crown of the golf club head. Thus, while Cunningham will assist the golfer in determining whether the club face is square to the ball at the point of impact, there is no interpretive visual information given to the golfer concerning the golfer's swing plane. Further, this condition provides no indication as to whether the swing is in an "in-to-out" or "out-to-in" condition, which may create what is termed to be a "push" or "pull". No information is provided to the golfer regarding the position of the club during the backswing or during the initial periods of the downswing.

Finally, Apthorp U.S. Pat. No. 5,897,441 teaches an improved device where two lasers are mounted so as to direct beams parallel to the club shaft in a plane which bisects the club face perpendicularly thereto. During the downswing, the laser beams trace two lines on the ground which should appear to cross one another at the point of impact, thus indicating to the golfer that the face of the club is square to the target at the point of impact. The same conditions and teachings insofar as the traces of two laser beams as they impinge on the ground, and the information concerning the golf club swing imparted by those traces, applies to the laser beam traces of the first pair of laser beam sources that are employed in the present invention.

The Apthorp patent also describes a device which has a third laser source that emits a beam of light in a direction which is substantially coaxial with the longitudinal axis of the golf club shaft, but in a direction away from the golf club head. During the latter part of the backswing and/or the initial stages of the downswing, the third laser traces a line on the ground and is representative of the true plane in which the shaft of the club is located. However, the third laser does not provide any indication as to the position of the club face during the latter stages of the backswing or the initial stages of the downswing. Thus, the Apthorp device will indicate to the golfer whether the golf club swing is in the correct plane, but provides no indication as to whether the club face is open, closed, or square, to the intended line of flight of the golf ball after impact. This may be of importance to the golfer, since an open or closed club face in the initial stages of the downswing must be manipulated back to a square position during the swing but prior to impact with the golf ball. If it can be seen that the club face is in a square position as the downswing begins, then the amount of manipulation required during the swing to square the face prior to the point of impact with the ball is minimized.

SUMMARY OF THE INVENTION

In accordance with one aspect of the present invention, there is provided a golf swing practice device for use with the golf club having a club head, a club shaft, and a grip portion, which comprises a body having first and second ends for securement to a golf club so that the first end is at the upper end of the golf club remote from the club head, and the second and is fitted to the club shaft at a position below the grip portion thereof.

The body has a pair of first laser light sources at the second end, each of which is directed downwardly and outwardly from the second end of the body so as to create diverging beams of light which pass by the front and rear faces of the club head in a first plane.

Typically, the securement of the body at the first end to the golf club is by a pin that is axially inserted into the end of the golf club shaft remote from the golf club head; and the second end the body is secured to the golf club shaft by a geared clamp which is positioned below the grip portion of the golf club, so as to be symmetrical about the longitudinal axis thereof.

The golf swing practice device of the present invention may typically comprise a second laser light source which is located near the first end of the body and which is directed so as to create a beam of light in a direction that is parallel to the longitudinal axis of the club shaft and away from the club shaft.

The second laser light source may create a beam of light which may be such that when it impinges on a target such as the ground it will form a dot of light or a line of light.

Still further, the golf swing practice device may incorporate a position sensitive switch which cooperates with the second laser light source in such a manner that the second laser light source is illuminated only when the golf club is oriented so that the club head is at an elevation equal to or above the position sensitive switch.

Moreover, the second laser light may be such that when it is configured so as to form a line of light, the locus of the line of light as it impinges on a target may be altered by a rotatable lens that is associated with the second laser light.

Typically, the geared clamp is spring loaded against the closing action of a locking shaft therefor.

Usually, the first pair of laser light sources is mounted so as to diverge in such a manner that when the light beams therefrom impinge on a target at the club head end of the golf club, the distance between the light in the impingement targets is in the range of 15 to 21 cm.

Typically, the body of the golf swing practice device of the present invention is formed from a polycarbonate plastic material.

Another aspect of the present invention is to provide a practice mat which may be used with a golf club—whether or not the golf club is fitted with the golf swing practice device of the present invention—and which comprises a first elevated zone and a second zone which is in a plane below the elevation of the first zone.

The first zone has the appearance and texture of grass or turf, and has at least a first location thereon were a golf ball may be placed so as to be struck by a golf club.

The second zone has a line placed thereon in the longitudinal direction of the mat so as to indicate the intended direction of a golf ball when struck, and at least a second location where a golf ball may optionally be placed so as to be struck by a golf club.

The length of the second zone is greater than that of the first zone.

The practice mat of the present invention may have fold lines thereacross, so that it may be folded for storage and/or transport.

The first zone of the practice mat of the present invention may be such that it is adapted to receive a golf tee when placed therein.

A pair of rows of discrete sensors may be placed, one at each end of the first zone so that each of the rows of sensors extends across the mat in the second zone thereof. The practice mat may also be provided with a microprocessor and an annunciator.

If so, the sensors are adapted to sense the presence of a golf club as it passes over the sensors, so that the speed of the golf club can be determined by the microprocessor and displayed or spoken by the annunciator.

Moreover, the direction of travel of the golf club can be determined as it passes over the rows of discrete sensors by the microprocessor acting in cooperation with respective ones of the discrete sensors in each row thereof.

When the practice mat is particularly intended to be used in association with the golf swing practice device of the present invention, then the sensors are specifically laser light sensors, and are adapted to sense the first beam of light from the pair of first laser light sources as that beam of light passes over the laser light sensors.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

The general features and components of the golf swing practice device in keeping with the present invention will first be discussed.

Figure 1:
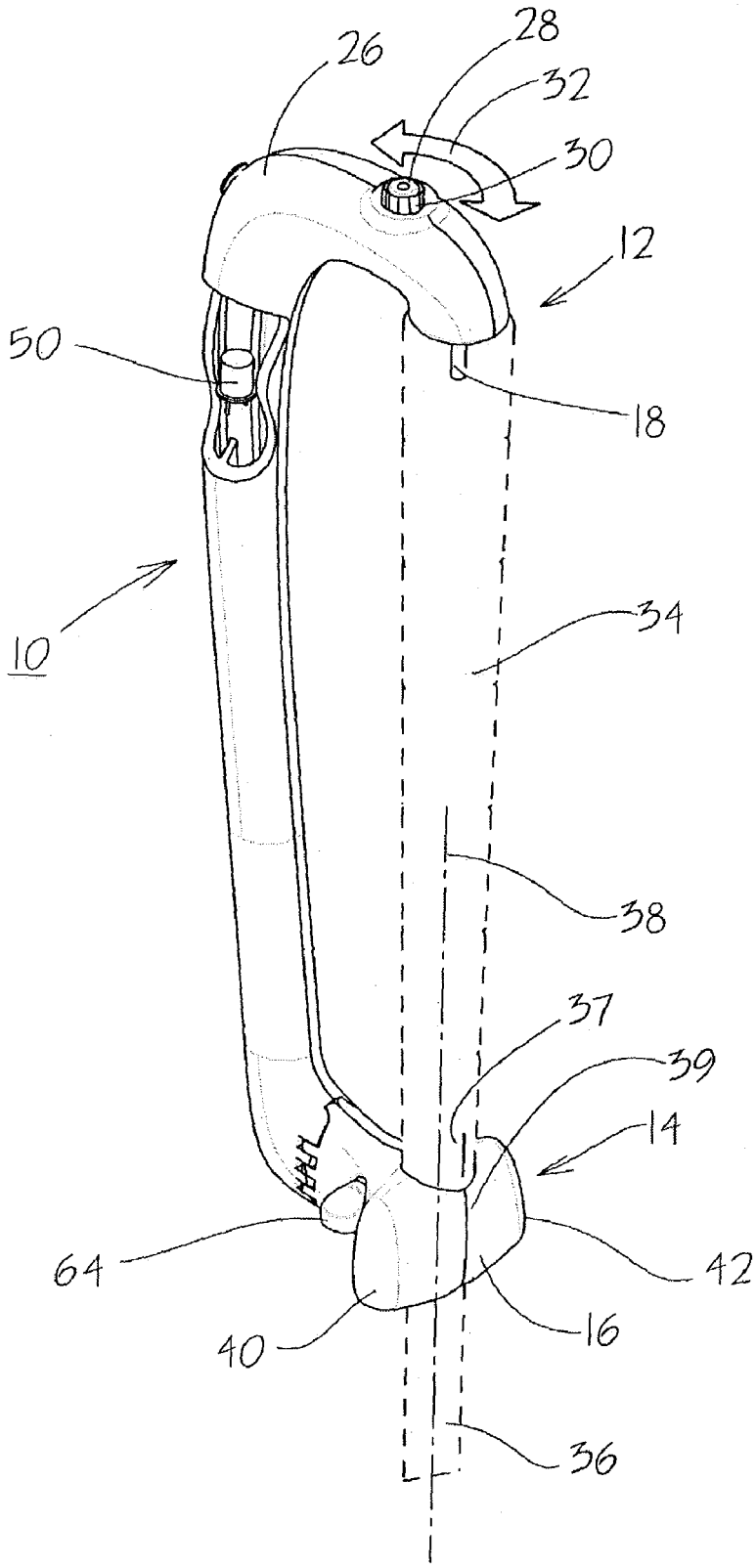
FIG. 1 is a perspective view of the golf swing practice device in keeping with the present invention, secured to the upper end of a golf club.
Figure 2:
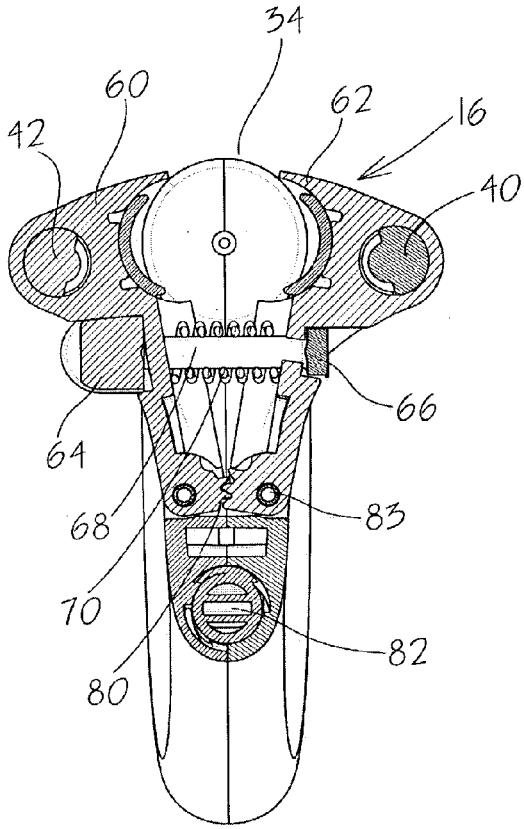
FIGS. 2 and 3 are bottom plan cross-section views showing the geared clamp portion of the golf swing practice device of the present invention in and open and closed condition, respectively.
Figure 3:
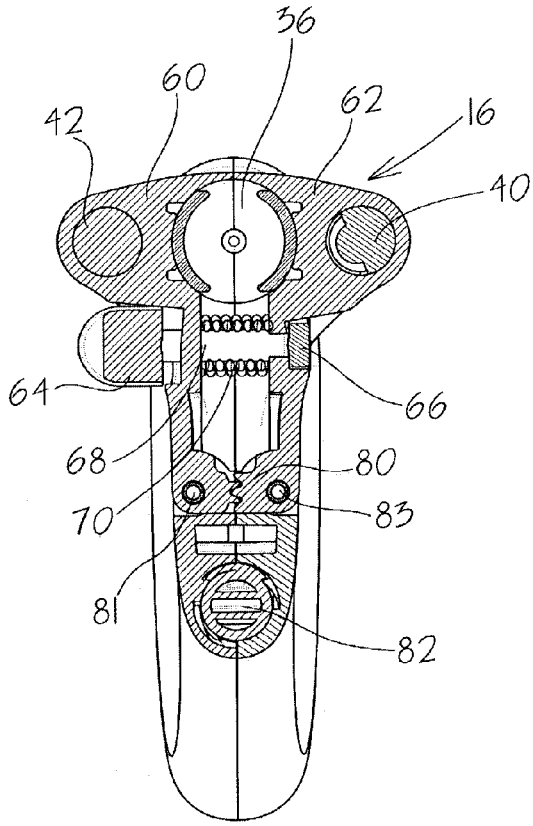
Figure 4:
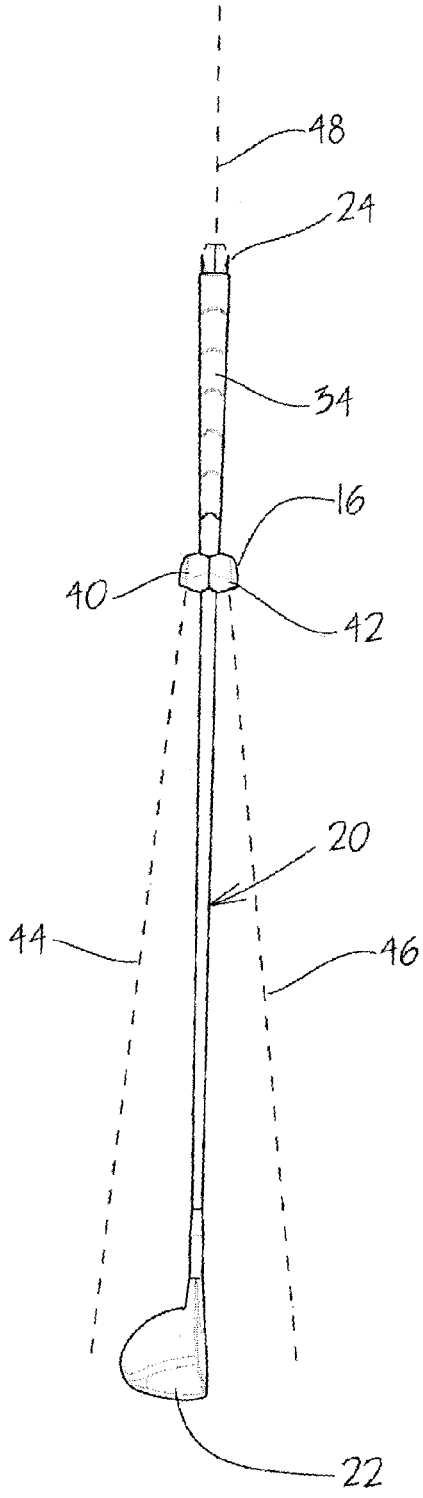
FIG. 4 is a front view of a golf club having a golf swing practice device in keeping with the present invention secured thereto, and showing the paths of beams of light that may be emitted by the respective laser light sources found in the golf swing practice device.

There is shown in FIGS. 1 to 4, in particular, a golf swing practice device 10 which is secured to a golf club 20. The precise nature of the golf club 20 is immaterial to the present invention; and it may be a wood (as shown in FIG. 4), or it may be an iron (as suggested in FIGS. 5 to 7). Indeed, the golf club may be a putter.

In any event, the golf swing practice device has a body that has a top or first end 12 and a second or bottom end 14. The first end 12 is secured to the golf club 20 such as by a pin 18 which is axially inserted into the end of the golf club 20.

Typically, the second end 14 is secured to the to the shaft of the golf club 20 by a geared clamp 16, the details of which are described hereafter. It will be seen that the body of the golf swing practice device 10 lies behind the grip portion 34 of the golf club 20 and is positioned in such a manner that it will not interfere with the hands of the golfer, neither will it interfere with the forearms of the golfer during a backswing or follow through of a golf stroke. This is in contradistinction to the structure particularly of the Apthorp device, which can interfere with the forearms of the golfer during a golf stroke. Moreover, the golf swing practice device of the present invention has a lower weight then the Apthorp device, and is less likely to convey a sense of imbalance of the golf club to the golfer.

A first pair of the light sources 40, 42 is situated in the second end 14 of the golf swing practice device 10, and they emit beams of light 44 and 46, respectively, as shown in FIG.

4. There is also a second laser light source 28 which is located near the first end 12 of the body of the golf swing practice device 10, and it will create a beam of light 48 which is directed away from the shaft of 36 of the golf club 20 but in a direction parallel to the longitudinal axis 38 of the golf club shaft 36.

As noted hereafter, the second laser light source 28 may be such that it is configured either to create a beam of light which, when it impinges on a target, will form either a dot of light or a line of light. If the second laser light source 28 is configured so that it emits a beam that will form a line of light, then the orientation of that line of light can be altered by twisting a lens 30 as shown by arrow 32.

So as to preclude the possibility of the second laser light source 28 shining into the eyes of the golfer, when the head 22 of the golf club 20 is down with respect to the grip 34 of the golf club, a position sensitive switch 50 may be employed which is such that the second laser light source 28 will be illuminated only when the golf club is oriented so that the club head is at an elevation which is equal to or above the elevation of the position sensitive switch 50.

Turning particularly to FIGS. 2 and 3, it will be seen that the bottom end 14 of the golf swing practice device 10 is configured so as to have a geared clamp by which it may be secured it to the shaft 36 of a golf club 20, below the grip portion 34 thereof. There are two halves of the body, noted at 60 and 62, respectively, and the rear side of the two halves 60 and 62 is configured so as to have an intermeshing gear arrangement 80. It will be seen by comparing FIGS. 2 and 3 that the halves 60 and 62 pivot about pins or shafts 81 and 83, respectively. It will also be seen that there is a captured nut 66 and a knob 64, which may also have the form of a screw head, associated with a locking shaft 68, so that engagement of the knob or head 64 will cause a screw drive of the shaft 68, whereby the halves 60 and 62 may be advanced one towards the other or retracted one away from the other. Typically, a compression spring 70 is provided, so that the geared clamp 16 is spring loaded against the closing action while the locking shaft 68. However, the precise details of the structure of the geared clamp 16 are beyond the scope of the present invention. On the other hand, it must be noted that the geared clamp 16 is such that its operation will ensure that the placement of the first pair of laser light sources 40, 42 is symmetric about a longitudinal axis 38 of the golf club 20.

Figure 5:
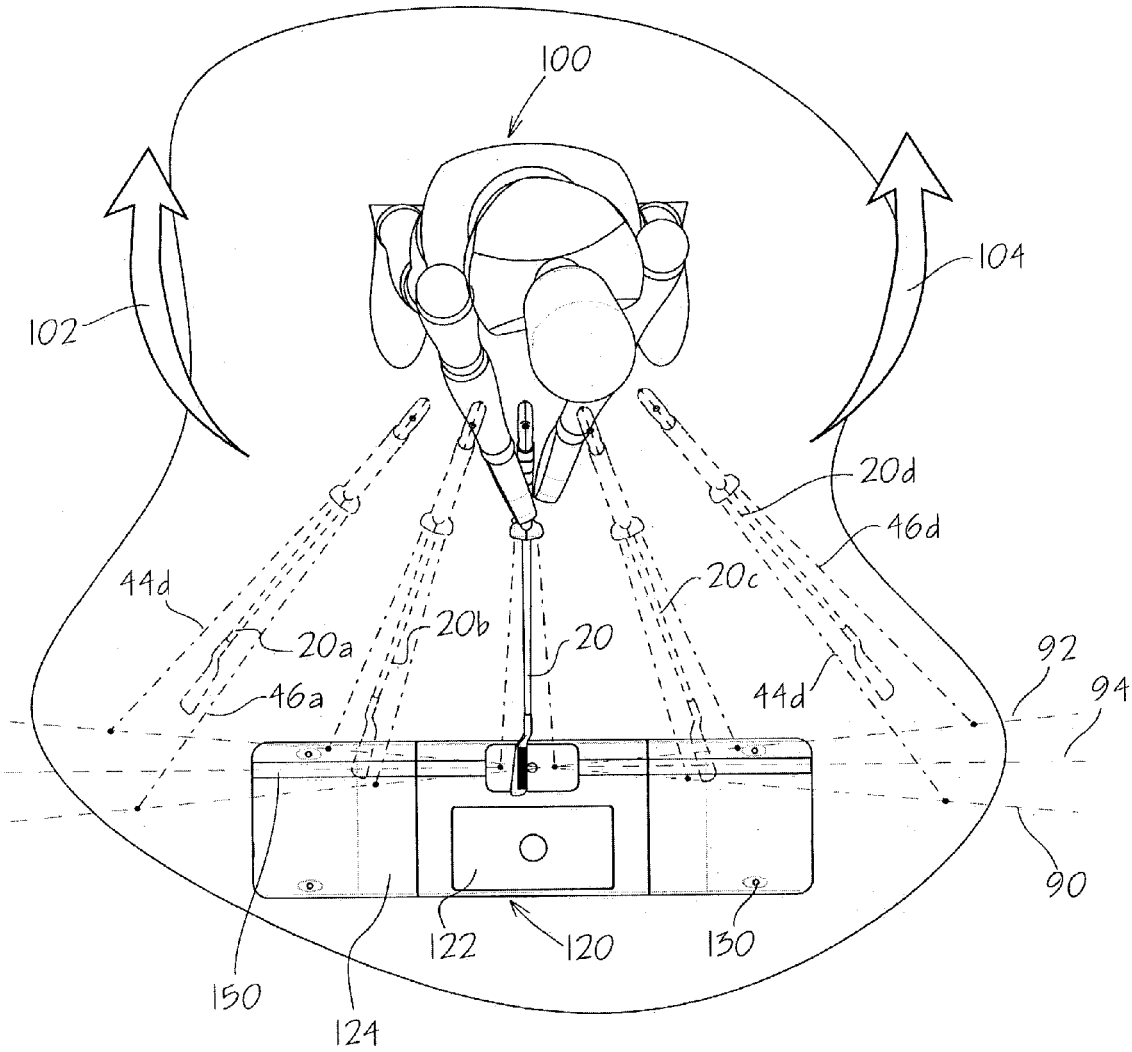
FIG. 5 is a top plan view of a golfer using the golf swing practice device of the present invention in association with a practice mat, and showing particularly tracings of laser light beams as they impinge on the ground and the mat in front of the golfer during various stages of the golf swing being taken by the golfer.

Turning now particularly to FIG. 5, the backswing 102 and the follow through 104 of a golfer 100 are shown. It is also seen that the golfer 100 has a club 20, and has placed a practice mat in front of him. The practice mat 120 has first and second zones 122 and 124, respectively, as discussed hereafter; and has a line 150 placed thereon. The line 150 indicates the direction of the intended flight of a golf ball when struck; or at least indicates the intended direction of flight of a golf ball if it were to be impacted by the head of the golf club 20. In other words, the line 150 provides an indication of the golfer 100, together with the golf swing practice device 10, of the accuracy of his swing. The paths of the beams 44 and 46 at respective positions of the golf club 20 as shown at 20*a,* 20*b,* 20*c,* and 20*d,* are shown, for example, at 44*a,* 46*a,* 44*d,* and 46*d;* and the tracings of those light beams 44 and 46 on the mat 120 and the surrounding ground in front of the golfer 100 are shown at 90 and 92. Line 94 is an imaginary line which is not illuminated by the laser light sources 40 and 42, but rather it together with the line 150 is intended to illustrate the direction flight of a golf ball if it were to be struck with a good golf swing.

It will be understood, of course, that the beams of laser light 44 and 46 which are emitted by the first pair of laser lights 40 and 42 are aimed in such a manner that they diverge and will pass the front and rear faces of the golf club 20 at the head 22. Moreover, the placement of the golf swing practice device 10 will be such that the plane within which the beams 44 and 46 are located will be perpendicular to the face of the golf club head 22. This is easily arranged by ensuring that a line 39 between the two halves 60 and 62 of the golf in practice device 10, is aligned with a line 37 which is formed in the grip portion 34 of a golf club 20 to indicate to the golfer the plane of the front phase of the golf club head 22. The beams from the laser lights 44 and 46 will typically impinge on the ground in the vicinity of the club head 22 at a distance apart which is in the range of 15 cm to 21 cm.

To that end, it will be seen that the tracings 90 and 92 cross over one another in the form of an "X", and if that swing is correct, then the crossover of the beam beams 90 and 92 will be at the intended point of impact. If the beams 90 and 92 do not intersect at the intended impact point, then that will indicate to the golfer 100 and/or an instructor/observer that the golf club 20 is being held in either a toe-in or a toe-out orientation. If the paths 90 and 92 cross before the intended point of impact, then the club 20 is being held in a toe-in or closed manner; and conversely, if the paths 90 and 92 cross after the intended point of impact, then the golf club 20 is being held in a toe-out or open manner.

Figure 6:
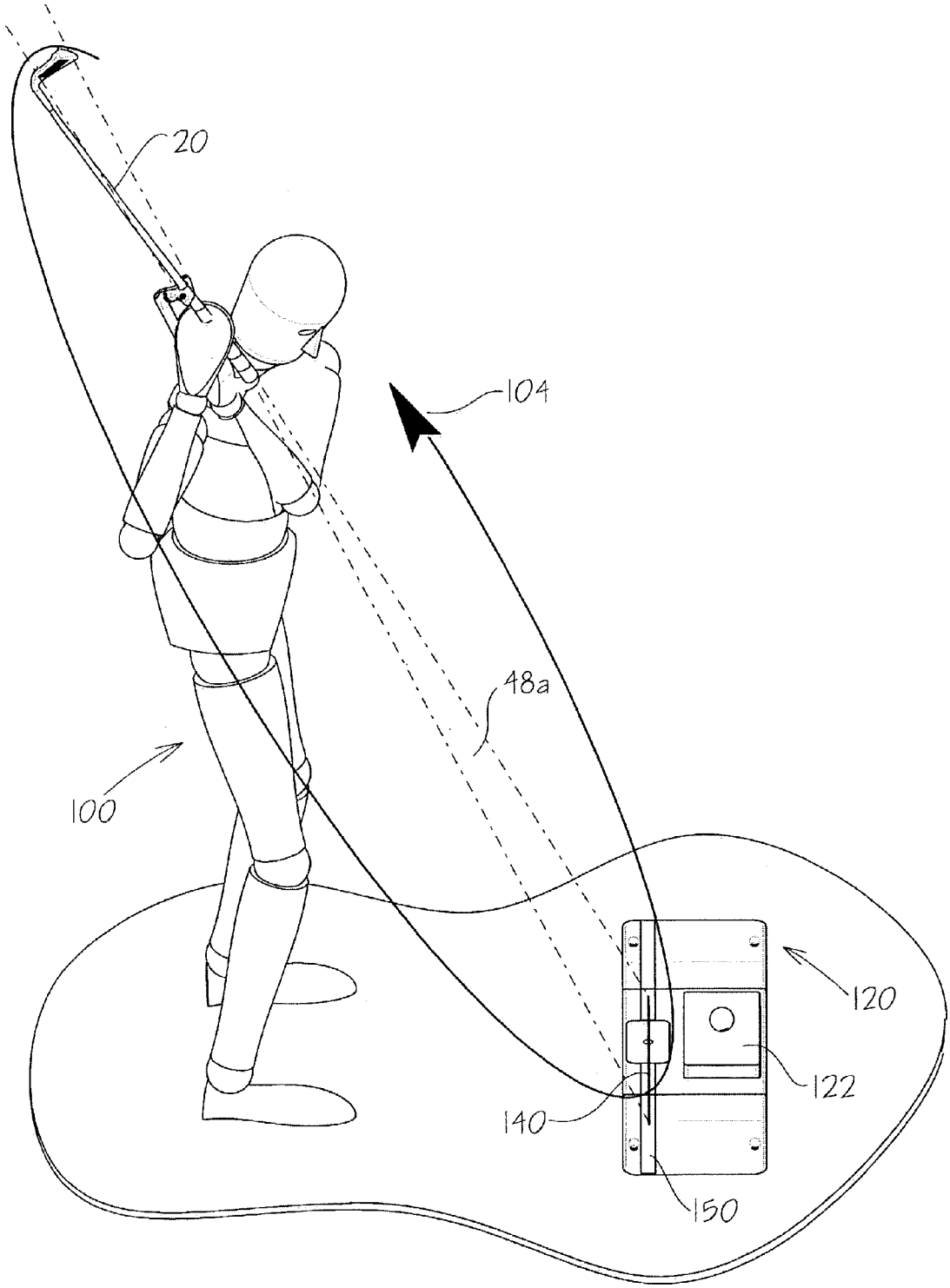
FIG. 6 is a perspective view of a golfer using the golf swing practice device in keeping with the present invention and showing the impingement of a light beam from a second laser light source located on the golf swing practice device as it impinges upon a practice mat.

Referring now to FIG. 6, the purpose and function of the second laser light source 28 is now discussed. As has been previously noted, the second laser light source 28 can be configured together with the position sensitive switch 50 so that it is only illuminated when the head of the golf club 20 is above the position sensitive switch 50. Thus, the beam 48 from the second laser light source 28 is seen only in situations such as that illustrated in FIG. 6, where the golf club is in a backswing situation, or has moved to a follow through situation as shown at 104. A particular purpose for the second laser light source 28 is therefore to indicate the plane through which the golf club 20 has been swung.

It will also be understood that the laser beam 48 may be such that when it impinges on the ground, it will form a dot. However, it may also be configured so that when a beam 48*a* impinges on the ground, it will form a line of light 140. The line of light 140 might, for example, be about 15 cm long for an average height golfer. Moreover, a lens 30 may be provided in association with the laser light 28 that may be rotated as shown at 32, so that an adjustment may be made by the golfer as necessary and appropriate to assure that for that particular golfer's stance, the intended and correct the plane for the golf swing will be effected.

Figure 7:
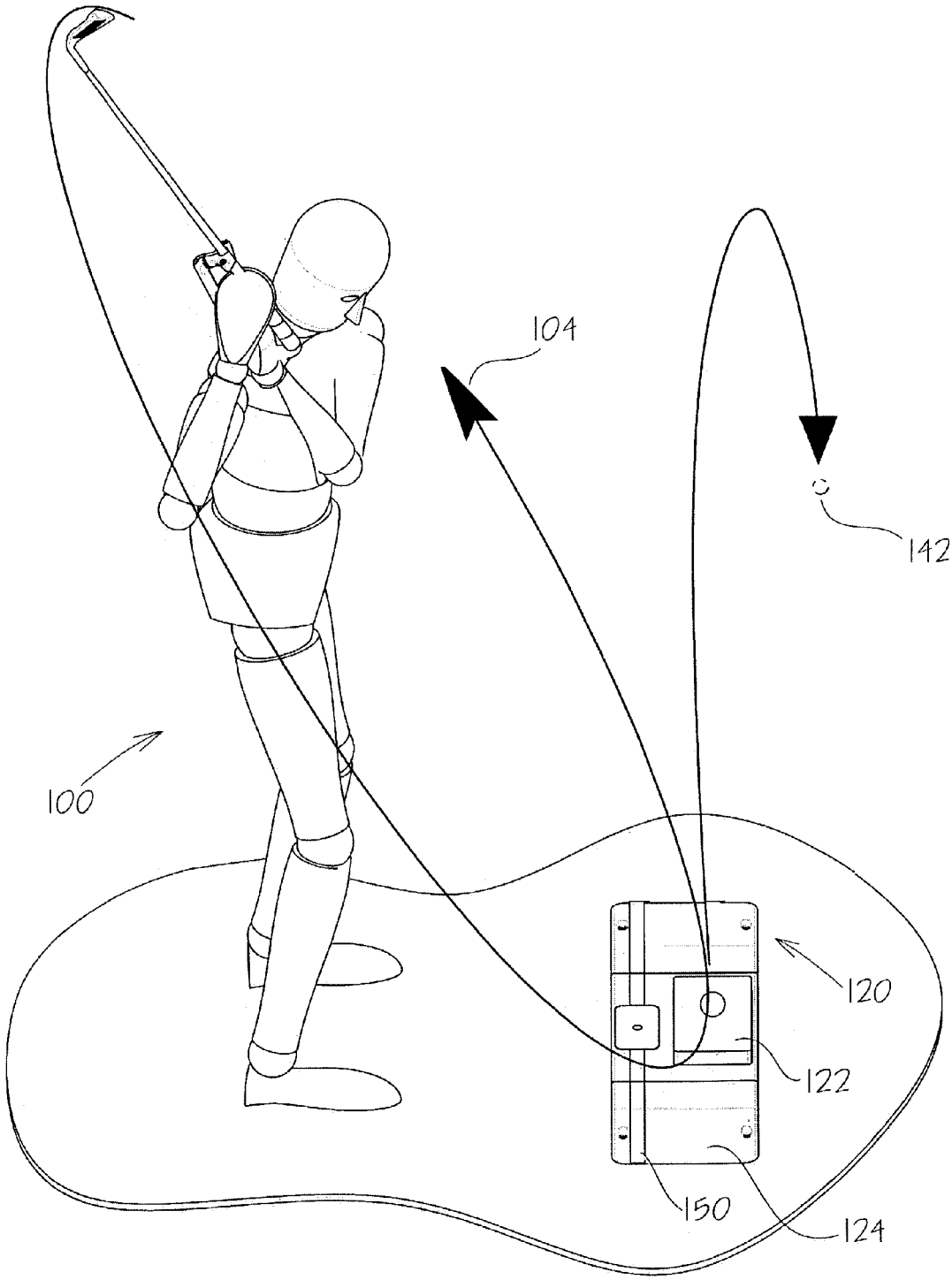
FIG. 7 is a view similar to FIG. 6, showing the backswing and the resultant impact with a golf ball of the golf club when the ball was placed in a first zone of the practice mat.

FIG. 7 shows the effect of the golfer who has taken several practice swings and been satisfied that the swings were correct, and has subsequently placed a golf ball 142 on the second zone 122 of the practice mat 120 and has struck the ball therefrom. Typically, after one or a few practice swings, if the golfer is comfortable with his stance and with the immediate muscle training so that an effective golf swing will occur, then the golfer shuffles his feet forward slightly so as to be able to strike the ball with the same swing and thereby achieve the flight of the golf ball which is intended.

Typically, the body of the golf swing practice device 10 is molded from a suitable plastics material, polycarbonate being particularly suitable because of its weight, rigidity, and strength.

Figure 8:
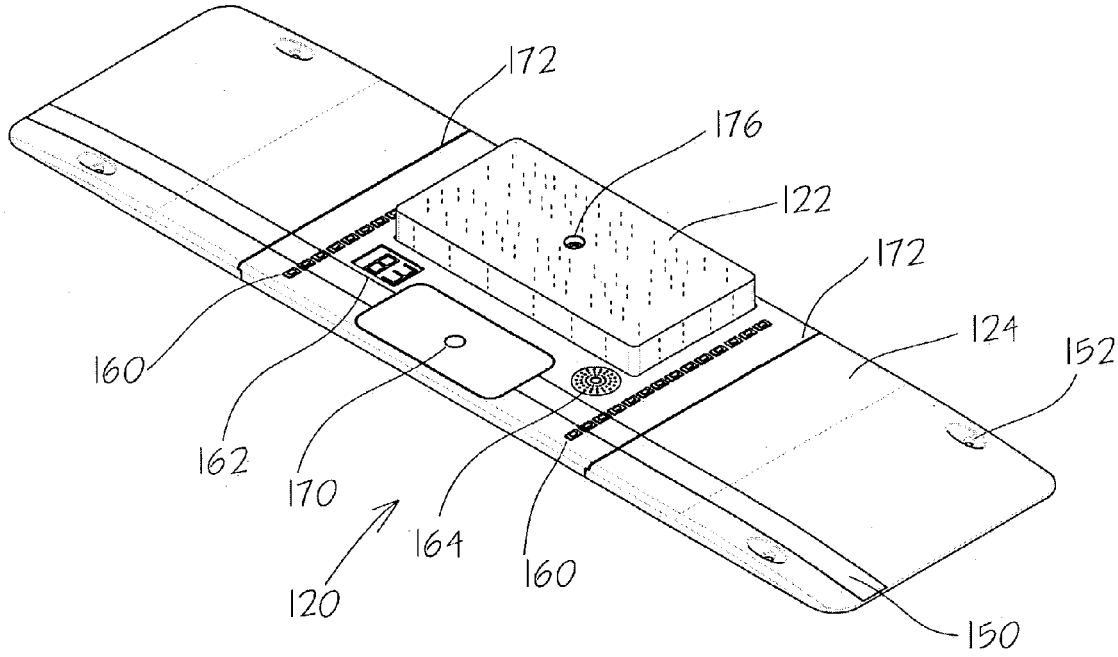
FIG. 8 is a perspective view of a practice mat in keeping with the present invention, and equipped with several optional features by which speed and direction of the head of a golf club as it passes over the mat may be determined and annunciated.
Figure 9:
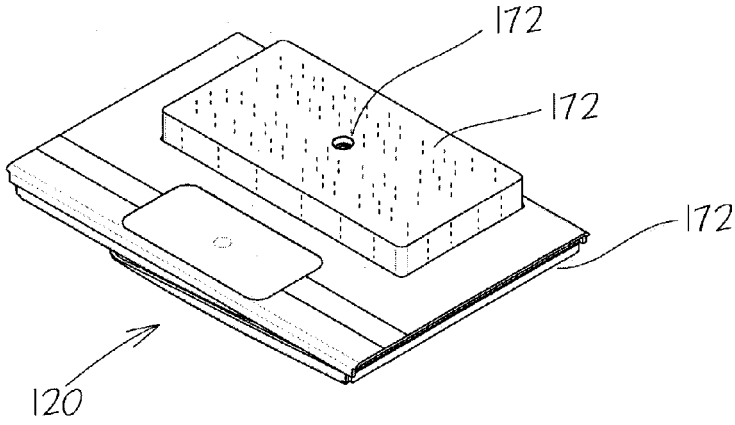
FIG. 9 is a perspective view of a more basic practice mat in keeping with the present invention, in a folded condition for storage and/or transport.

FIGS. 8 and 9 show several different embodiments of a practice mat which is also provided by the present invention, and which may be employed either in association with an ordinary golf club or, more advantageously, in association with a golf club to which a golf swing practice device in keeping with the present invention has been attached.

A basic practice mat 120 in keeping with present invention comprises two zones 122 and 124. The first zone, 122, is elevated with respect to the second zone 124, and is much smaller. Moreover, the appearance and texture of the first zone 122 is such that it emulates grass or turf, and is such that it will withstand repeated impact from a golf club without being damaged. A first location 176 is placed in the first zone 122, so that a golf ball may be placed in the dimple or rubber tee and struck as if it were being played off the fairway or tee-off location of a golf course. Still further, the first zone 122 may be such that a conventional golf tee may be inserted thereinto.

The second zone 124 has a line 150 marked on it, the purpose of which is to indicate the intended line of flight of a golf ball if it were to be struck from a position such as position 170, or the line 150 is parallel to the intended line of flight of a golf ball if it were struck from position 176. Position 170 is particularly useful when a golfer is practising putting strokes.

In any event, it will be seen that the second zone 124 has a greater length than that of the first zone 122, and is at a lower elevation. Any practice mat 120 in keeping with present invention may have a pair of fold lines 172 across the second zone 124, so that the practice mat may be folded as indicated in FIG. 9 for storage and/or transport.

The practice mat 120 may also be equipped with two rows of discrete sensors, as shown at 160. The sensors 160 also extend crosswise of the mat in the second zone 124, and are associated with a microprocessor, not shown. There may also be an annunciator which may be such as an LED or LCD display 162, or a speaker 164, or both.

It will be understood that if any golf club passes over the sensors 160, then those sensors together with the microprocessor, can determine the speed at which the golf club has passed over the practice mat 120 in the impact zone at which a golf ball might be placed. Knowledge of the speed of the golf club head is indicative of the distance that the ball might travel upon impact, with the knowledge of the specific club that has been used.

Moreover, if the practice mat 120 is to be used in association with a golf swing practice device in keeping with present invention, then the sensors 160 can be particularly equipped to detect laser light. In that case, the sensors will be programmed to work in association with the microprocessor to sense only the first of the two laser light beams 44 or 46 as they pass over the rows of sensors, and to ignore the other laser light beam. It will be understood, in that regard, that any practice mat 120 in keeping with present invention is equally capable of being used by any golfer whether or not they are left-handed or right-handed.

It will also be understood that because the rows of sensors 160 comprise discrete sensors, additional information can be derived as to the specific direction of a golf club as it passes over the rows of discrete sensors 160.

A practice mat in keeping with the present invention can, in fact, provide to a golfer a portable practice area from which to practice the golf swings for all kinds of golf clubs. For example, a golfer could practice wood and iron strokes as if from a tee-off area or from the fairway, by placing golf balls on the first zone 122, without actually having to be at a golf driving range or a golf course. Moreover, putting can be practised almost anywhere, because of the presence of the line 150, and of the sensors 160 if present. It can also be understood that a practice mat 120 can be secured to the ground by passing conventional golf tees 130 through dimples 152 which are provided for that purpose. See, for example, FIG. 5.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially parallel is intended to mean parallel, nearly parallel and/or exhibiting characteristics associated with parallelism.

Moreover, use of the terms "he", "him", or "his", is not intended to be specifically directed to persons of the masculine gender, and could easily be read as "she", "her", or "hers", respectively.

What is claimed is:

1. A golf swing practice device for use with a golf club having a club head, a club shaft, and a grip portion, said golf swing practice device comprising:

a body having first and second ends for securement to a golf club so that said first end is at the upper end of said golf club remote from said club head, and said second end is fitted to the club shaft at a position below the grip portion thereof;

wherein said body has a pair of first laser light sources at said second end, each of said laser light sources being directed downwardly and outwardly from said second end of said body so as to create diverging beams of light which pass by the front and rear faces of said club head in a first plane; and wherein the securement of said body at said first end thereof to said golf club is by a pin axially inserted into the end of the golf club remote from said club head, and at said second end thereof by a geared clamp positioned below the grip portion of said golf club so as to be symmetrical about said longitudinal axis thereof.

2. The golf swing practice device of claim 1, further comprising a second laser light source located near the first end of said body and directed so as to create a beam of light in a direction parallel to the longitudinal axis of said club shaft and away from said club shaft.

3. The golf swing practice device of claim 2, wherein said second laser light source creates a beam of light having a configuration chosen from those that are such that when said light impinges on a target it will form a dot of light or a line of light.

4. The golf swing practice device of claim 3, wherein when said second laser light is such as to form a line of light, the focus of said line of light as it impinges on a target may be altered by a rotatable lens associated with said second laser light.

5. The golf swing practice device of claim 2, wherein said device further comprises a position sensitive switch cooperating with said second laser light source in such a manner that said second laser light source is illuminated only when said golf club is oriented so that said club head is at an elevation equal to or above said position sensitive switch.

6. The golf swing practice device of claim 1, wherein said geared clamp is spring loaded against the closing action of a locking shaft therefor.

7. The golf swing practice device of claim 1, wherein said pair of first laser light sources diverges in such a manner that when the light beams therefrom impinge on a target at the club head end of said golf club, the distance between the light impingement targets is in the range of 15 to 21 cm.

8. The golf swing practice device of claim 1, wherein the body of said device is formed from a polycarbonate plastics material.

* * * * *